US012274333B2

(12) United States Patent
Rodon Viñals et al.

(10) Patent No.: US 12,274,333 B2
(45) Date of Patent: Apr. 15, 2025

(54) FORMING AND APPLYING A MATED FASTENER ASSEMBLY

(71) Applicant: Velcro IP Holdings LLC, Manchester, NH (US)

(72) Inventors: Enric Rodon Viñals, Mataro (ES); Jose Manuel Sampaio Camacho, Parede (PT); Luis Parellada Armela, Girona (ES)

(73) Assignee: Velcro IP Holdings LLC, Manchester, NH (US)

( * ) Notice: Subject to any disclaimer, the term of this patent is extended or adjusted under 35 U.S.C. 154(b) by 1122 days.

(21) Appl. No.: 17/059,174

(22) PCT Filed: May 29, 2019

(86) PCT No.: PCT/EP2019/063893
§ 371 (c)(1),
(2) Date: Nov. 25, 2020

(87) PCT Pub. No.: WO2019/229100
PCT Pub. Date: Dec. 5, 2019

(65) Prior Publication Data

US 2021/0212416 A1 Jul. 15, 2021

Related U.S. Application Data

(60) Provisional application No. 62/678,331, filed on May 31, 2018.

(51) Int. Cl.
*B65B 51/04* (2006.01)
*A44B 18/00* (2006.01)
(Continued)

(52) U.S. Cl.
CPC ..... *A44B 18/0073* (2013.01); *A44B 18/0011* (2013.01); *A44B 18/0015* (2013.01);
(Continued)

(58) Field of Classification Search
CPC ..... A44B 18/0073; A44B 18/0011; A44B 18/0015; B65B 51/04; B65D 77/12; B65H 18/28; B65H 2701/19404
(Continued)

(56) References Cited

U.S. PATENT DOCUMENTS 3,353,663 A 11/1967 Kayser et al.
4,290,832 A 9/1981 Kalleberg
(Continued)

FOREIGN PATENT DOCUMENTS

CN 1325280 12/2001
CN 101959436 1/2011
(Continued)

OTHER PUBLICATIONS

International Search Report and Written Opinion for related International Application No. PCT/EP219/063893; dated Aug. 12, 2019, 13 pages.
(Continued)

*Primary Examiner* — Hemant Desai
*Assistant Examiner* — Mary C Hibbert-Copeland
(74) *Attorney, Agent, or Firm* — Fish & Richardson P.C.

(57) ABSTRACT

A mechanical touch fastener assembly (10,101) including two longitudinally continuous tapes (16), (18) carrying engaged fastener patches (12,12*a*), (14,14*a*,14*b*,14*c*). The first tape (16) carrying a series of first fastener patches (12,12*a*) arranged in a row along a length of the tape (16) and carrying a field of touch fastening features. Each first patch longitudinally spaced from adjacent first patches (12, 12*a*). The second tape (18) carrying a series of second fastener patches (14,14*a*,14*b*,14*c*) carrying a second field of touch fastening features. The first (16) and second (18) tapes including a release liner (22), (24). The first (16) and second (18) tapes wound together to form a roll (60), with each of
(Continued)

the first fastener patches (12,12*a*) releasably engaged to a respective one of the second fastener patches (14,14*a*,14*b*, 14*c*) by inter-engagement of the first and second touch fastening features. As wound to form the roll (60), one patch of an engaged pair (25) has a leading edge (52,52*b*,52*c*) disposed behind a leading (50) edge of another patch of the engaged pair (25).

17 Claims, 9 Drawing Sheets

(51) Int. Cl.
*B65D 77/12* (2006.01)
*B65H 18/28* (2006.01)

(52) U.S. Cl.
CPC ..... *B65B 51/04* (2013.01); *B65D 77/12* (2013.01); *B65H 18/28* (2013.01); *B65H 2701/19404* (2013.01)

(58) Field of Classification Search
USPC ..... 53/416
See application file for complete search history.

(56) References Cited

U.S. PATENT DOCUMENTS

| | | | | |
|---|---|---|---|---|
| 4,546,879 | A | 10/1985 | Viscasillas | |
| 4,646,397 | A | 3/1987 | Yoshida | |
| 4,732,631 | A * | 3/1988 | Shimizu | B31D 1/021 156/580.2 |
| 4,775,310 | A | 10/1988 | Fischer | |
| 5,172,980 | A | 12/1992 | Provost | |
| 5,700,340 | A | 12/1997 | Johnson et al. | |
| 5,930,139 | A | 7/1999 | Chapdelaine et al. | |
| 6,045,037 | A | 4/2000 | McGeehin | |
| 6,202,260 | B1 | 3/2001 | Clune et al. | |
| 6,205,623 | B1 | 3/2001 | Shepard et al. | |
| 6,235,369 | B1 | 5/2001 | Shepard et al. | |
| 6,851,161 | B2 | 2/2005 | Kingsford et al. | |
| 6,991,375 | B2 | 1/2006 | Clune et al. | |
| 7,132,144 | B2 | 11/2006 | Roberts | |
| 7,163,706 | B2 | 1/2007 | Shepard et al. | |
| 7,186,025 | B2 | 3/2007 | Shepard et al. | |
| 7,308,783 | B2 | 12/2007 | Shepard et al. | |
| 7,395,583 | B2 | 7/2008 | Clune et al. | |
| 7,406,810 | B2 | 8/2008 | Clune et al. | |
| 7,424,796 | B2 | 9/2008 | Shepard et al. | |
| 7,638,013 | B2 | 12/2009 | Hiller et al. | |
| 8,051,540 | B2 | 11/2011 | Gallant et al. | |
| 8,225,467 | B2 | 7/2012 | Gallant et al. | |
| 8,858,077 | B2 | 10/2014 | Shepard | |
| 2004/0031130 | A1 * | 2/2004 | Clarner | B29C 43/46 24/452 |
| 2005/0280175 | A1 * | 12/2005 | Tachauer | B29C 48/08 425/130 |
| 2006/0249247 | A1 | 11/2006 | DeGrand | |
| 2011/0308716 | A1 | 12/2011 | Peterson | |

FOREIGN PATENT DOCUMENTS

| | | | | |
|---|---|---|---|---|
| DE | 60102220 | | 3/2005 | |
| EP | 1060682 | A1 * | 12/2000 | A44B 18/0003 |
| EP | 1127011 | | 10/2002 | |
| EP | 1304213 | | 4/2003 | |
| EP | 1326783 | | 3/2005 | |
| EP | 1143819 | | 2/2006 | |
| EP | 1681155 | | 7/2006 | |
| EP | 1669000 | | 6/2010 | |
| EP | 2140775 | | 8/2011 | |
| EP | 2244599 | | 5/2014 | |
| GB | 1438721 | A | 6/1976 | |
| JP | 2011-037521 | | 2/2011 | |
| WO | WO 2000/076865 | | 12/2000 | |
| WO | 2013122271 | A1 | 8/2013 | |

OTHER PUBLICATIONS

Kittenband-outlet.nl [online], "Klittenband Rondjes plakbaar binnengebruik," available on or before Apr. 8, 2017, via Internet Archive: Wayback Machine URL <https://web.archive.org/web/20170408091440/http://www.klittenband-outlet.nl/plakbare-klittenband-rondjes/klittenband-rondjes-plakbaar-binnengebruik/>, retrieved on Mar. 3, 2021, URL<http://www.klittenband-outlet.nl/plakbare-klittenband-rondjes/klittenband-rondjes-plakbaar-binnengebruik/>, 3 pages (with Machine Translation).

PCT International Search Report and Written Opinion in International Appln. No. PCT/EB2019/063893, dated Aug. 12, 2019, 12 pages.

* cited by examiner

FORMING AND APPLYING A MATED FASTENER ASSEMBLY

CROSS-REFERENCE TO RELATED APPLICATIONS

This application is a U.S. National Stage Application under 35 USC § 371 and claims the benefit of International Patent Application No. PCT/EP2019/063893 filed on May 29, 2019, which claims the benefit of provisional U.S. Provisional Patent Application No. 62/678,331, filed on May 31, 2018, and each of the foregoing applications are hereby incorporated by reference in their entirety.

TECHNICAL FIELD

This invention relates to equipment and processes for making and applying mated touch fastener assemblies.

BACKGROUND

Many packages have features that enable a user to quickly open and close the package. Some features include package closures that are applied to or built into packages using an automated application process. It is desirable that a package closure be not only easy to operate but also inexpensive and easy to apply. Improvements in the manufacturing and application processes of touch fastener assemblies are sought.

SUMMARY

One aspect of the invention features a mechanical touch fastener assembly that includes a first longitudinally continuous tape carrying a series of first fastener patches on a surface thereof. The first patches are arranged in a row along a length of the first tape, carrying a field of first touch fastening features on a surface opposite the first tape. Each first patch is longitudinally spaced from adjacent first patches such that the first tape surface is exposed between the first patches. The touch fastener assembly further includes a second longitudinally continuous tape carrying a series of second fastener patches on a surface thereof, the second patches arranged in a row along a length of the second tape and carrying a field of second touch fastening features on a surface opposite the second tape. Each second patch is longitudinally spaced from adjacent second patches such that the second tape surface is exposed between the second patches. The first tape includes a first release liner covering adhesive surfaces of the first fastener patches. The second tape includes a second release liner covering adhesive surfaces of the second fastener patches. The first and second tapes are wound together to form a roll, with each of the first fastener patches releasably engaged to a respective one of the second fastener patches by inter-engagement of the first and second touch fastening features. The engaged fastener patches are disposed between the first and second release liners. As wound to form the roll, one patch of an engaged pair of first and second fastener patches has a leading edge disposed behind a leading edge of another patch of the engaged pair of first and second fastener patches, in an unwind direction of the roll.

In some cases, one of the field of first touch fastening features and the field of second touch fastening features includes an engageable fibrous surface, and the other of the field of first touch fastening features and the field of second touch fastening features includes a field of discrete hooks configured to engage the engageable fibrous surface. In some examples, the engageable fibrous surface includes a non-woven material. In some cases, the hooks have discrete resin stems extending from a common layer of resin extending across and forming a base of a corresponding patch.

In some examples, the field of first touch fastening features and the field of second touch fastening features include complementary arrays of hooks arranged to releasably engage when pressed together.

In some embodiments, as wound to form the roll, the patch having leading edge disposed behind the leading edge of the other patch is an outer patch of the engaged pair of first and second fastener patches.

In some examples, as wound to form the roll, at least one patch of an engaged pair of first and second fastener patches has a width, in a direction across the tapes, that increases with distance from a leading end of the outer patch. In some cases, as wound to form the roll, an outer patch of an engaged pair of first and second fastener patches has a width, in a direction across the tapes that increases with distance from a leading end of the outer patch.

In some implementations, as wound to form the roll, one patch of an engaged pair of first and second fastener patches has an overall area that is less than an overall area of another patch of the engaged pair of first and second fastener patches. In some cases, as wound to form the roll, the patch having an overall area that is less than an overall area of the other patch is an outer patch of the engaged pair of first and second fastener patches.

In some cases, as wound to form the roll, an outer patch of an engaged pair of first and second fastener patches carries a field of discrete hooks as fastening elements, and an inner patch of the engaged pair of first and second fastener patches has a fibrous surface engageable by the discrete hooks.

Another aspect of the invention features a wound roll of touch fastener material, including a longitudinally continuous tape carrying a series of first fastener patches on a surface thereof. The first patches are arranged in a row along a length of the tape carrying a field of first touch fastening features on a surface opposite the tape. Each first patch is longitudinally spaced from adjacent first patches such that the tape surface is exposed between the first patches. The first patches are attached to the tape by first peelable adhesive connections, such that the tape forms a release liner peelable from the first patches. A series of second fastener patches are carried on the first patches, with each second fastener patch overlaying a respective one of the first patches and spaced from the tape surface. The first and second patches carry mating touch fastener elements, such that the first and second patches form releasably engaged fastening pairs defining touch fastening interfaces therebetween. The second fastener patches each carry an adhesive layer on a side opposite the touch fastener elements. With the fastener assembly wound, the adhesive layers carried by the second fastener patches directly engage the tape on a side of the tape opposite the first fastener patches to form second peelable adhesive connections. As wound to form the roll, one patch of an engaged fastening pair of first and second fastener patches has a leading edge disposed behind a leading edge of another patch of the engaged fastening pair of first and second fastener patches, in an unwind direction of the roll. The first and second peelable adhesive connections and the touch fastening interfaces are configured to enable peeling of the second peelable adhesive connections by unwinding the fastener material, while leaving the touch fastening interfaces and first peelable adhesive connections unpeeled.

In some implementations, the mating touch fastener elements of one of the first and second fastener patches include an engageable fibrous surface, and the mating touch fastener elements of another of the first and second fastener patches include a field of discrete hooks configured to engage the engageable fibrous surface. In some cases, the engageable fibrous surface includes a non-woven material. In some examples, the hooks have discrete resin stems extending from a common layer of resin extending across and forming a base of a corresponding patch.

In some embodiments, the mating touch fastener elements of the first and second fastener patches include complementary arrays of hooks arranged to releasably engage when pressed together.

In some cases, as wound to form the roll, the patch having leading edge disposed behind the leading edge of the other patch is an outer patch of the engaged fastening pair of first and second fastener patches.

In some examples, as wound to form the roll, at least one patch of an engaged fastening pair of first and second fastener patches has a width, in a direction across the tapes, that increases with distance from a leading end of the outer patch.

In some cases, as wound to form the roll, an outer patch of an engaged fastening pair of first and second fastener patches has a width, in a direction across the tapes, that increases with distance from a leading end of the outer patch.

In some implementations, as wound to form the roll, one patch of an engaged fastening pair of first and second fastener patches has an overall area that is less than an overall area of another patch of the engaged pair of first and second fastener patches. In some cases, as wound to form the roll, the patch having an overall area that is less than an overall area of the other patch is an outer patch of the engaged pair of first and second fastener patches.

In some embodiments, as wound to form the roll, an outer patch of an engaged fastening pair of first and second fastener patches carries a field of discrete hooks as fastening elements, and an inner patch of the engaged pair of first and second fastener patches has a fibrous surface engageable by the discrete hooks.

Another aspect of the invention features a method of forming a wound roll of touch fastener assembly, the method including sensing position of patches of a first touch fastener material spaced apart along a first longitudinally continuous release liner. The method further includes controlling, as a function of the sensed position, die cutting of a longitudinally continuous length of a second touch fastener material carried on a second longitudinally continuous release liner. The method also includes removing portions of the die cut second touch fastener material to leave patches of the second touch fastener material carried on the second release liner. The method further includes bringing each of the patches of first touch fastener material into engagement with a respective one of the patches of second touch fastener material, to form a mated, longitudinally continuous fastener assembly with releasably engaged patch pairs disposed between the first and second release liners. The method further includes winding the longitudinally continuous fastener assembly to form a roll of the touch fastener assembly.

In some examples, controlling the die cutting includes using a master/slave electronic cam system that controls, as a function of the sensed position, a slave die-cut station configured to die-cut the second touch fastener material. In some embodiments, the slave die-cut station includes a die-cut roll, and controlling the die cutting includes retarding or advancing the rotation of the die-cut roll to increase or decrease the longitudinally continuous length of the second touch fastener material. In some cases, sensing position of patches of the first touch fastener material includes using a registration sensor. In some examples, the registration sensor is configured to sense a registration mark near each patch. In some cases, the registration sensor is configured to sense a visual or proximity contrast between the patches and the release liner. In some implementations, the registration sensor is configured to generate data representative of a position of the patches and send the data to the slave die-cut station.

In some examples, the method further includes controlling, as a function of the sensed position, a feeding speed of the second release liner.

In some cases, the method further includes, prior to the winding, removing one of the first and second release liners, exposing an adhesive surface of one of the patches of the releasably engaged pair of patches. In some embodiments, the winding includes winding the assembly to form a roll with the adhesive surface in direct contact with, and peelable from, a back surface of one of the first and second release liners, such that both the front and back surfaces of the one of the first and second release liners form a release liner of the patches.

In some cases, controlling the die cutting of the longitudinally continuous length of the second touch fastener material includes die cutting patches at a pitch such that, as wound to form the roll, one patch of a releasably engaged patch pair has a leading edge disposed behind a leading edge of another patch of the releasably engaged patch pair, in an unwind direction of the roll.

In some embodiments, one of the first touch fastener material and second touch fastener material includes an engageable fibrous surface, and the other of the first touch fastener material and second touch fastener material includes a field of discrete hooks configured to engage the engageable fibrous surface.

In some implementations, the first touch fastener material and the second touch fastener material include complementary arrays of hooks arranged to releasably engage when pressed together.

Another aspect of the invention features a method of forming a wound roll of touch fastener assembly, the method including cutting through two engaged strips of touch fastener material carried on a carrier strip, to form a series of discrete patches of engaged fastener material spaced apart in a longitudinal direction along the carrier strip. The method further includes removing a matrix waste of the engaged touch fastener material from the carrier strip, leaving the series of discrete patches surrounded by exposed surface of the carrier strip. The method further includes applying adhesive and a continuous release liner to exposed surfaces of the patches opposite the carrier strip, to form a touch fastener assembly including the series of discrete patches of engaged fastener material sandwiched between the carrier strip and the release liner. The method also includes winding the touch fastener assembly to form a roll of the touch fastener assembly.

In some examples, applying the adhesive and the continuous release liner includes first applying the adhesive to the exposed surfaces of the patches, and then applying the release liner to cover the applied adhesive. In some cases, the adhesive is applied by roll-coating the exposed surface.

In some cases, the carrier strip includes a release liner strip to which the discrete patches are attached by a peelable adhesive, such that the touch fastener assembly includes the series of discrete patches sandwiched between peelable release liners.

In some implementations, the method further includes, prior to the cutting, bringing together two separate strips of touch fastener material to form the engaged strips of touch fastener material.

In some embodiments, one of the two engaged strips of touch fastener material includes an engageable fibrous surface, and the other of the two engaged strips of touch fastener material includes a field of discrete hooks configured to engage the engageable fibrous surface.

In some cases, the two engaged strips of touch fastener material include complementary arrays of hooks arranged to releasably engage when pressed together.

In some examples, the two engaged strips of touch fastener material are adhered to the carrier strip by a hot melt pressure sensitive tape.

In some cases, the release liner has an elasticity that is greater than an elasticity of the patches opposite the carrier strip.

In some implementations, the cutting includes die cutting patches that have a width, in a direction across the carrier strip, that increases with distance from a leading end of the patches.

Another aspect of the invention features a method of forming a wound roll of touch fastener assembly, the method includes cutting through two engaged strips of touch fastener material adhered to a front surface of a carrier strip by a peelable adhesive, to form a series of discrete patches of engaged fastener material spaced apart in a longitudinal direction along the carrier strip. The method further includes removing a matrix waste of the engaged touch fastener material from the carrier strip, leaving the series of discrete patches surrounded by exposed front surface of the carrier strip. The method includes applying adhesive to exposed surfaces of the patches opposite the carrier strip to form a touch fastener assembly, and then winding the touch fastener assembly to form a roll of the touch fastener assembly. The applied adhesive is in direct contact with, and peelable from, a back surface of the carrier strip, such that both the front and back surfaces of the carrier strip form a release liner of the patches.

In some cases, the adhesive is applied by roll-coating the exposed surface. In some examples, the adhesive is allowed to solidify before winding the touch fastener assembly.

In some examples, the method further includes, prior to the cutting, bringing together two separate strips of touch fastener material to form the engaged strips of touch fastener material.

In some embodiments, one of the two engaged strips of touch fastener material includes an engageable fibrous surface, and the other of the two engaged strips of touch fastener material includes a field of discrete hooks configured to engage the engageable fibrous surface.

In some embodiments, the two engaged strips of touch fastener material include complementary arrays of hooks arranged to releasably engage when pressed together.

In some cases, the carrier strip has an elasticity that is greater than an elasticity of the strip of touch fastener material directly adhered to the front surface of the carrier strip.

In some examples, the carrier strip has an elasticity that is the same as an elasticity of the strip of touch fastener material directly adhered to the front surface of the carrier strip. In some implementations, the peelable adhesive includes a hot melt pressure sensitive tape.

In some examples, the cutting includes die cutting patches that have a width, in a direction across the carrier strip, that increases with distance from a leading end of the patches.

Yet another aspect of the invention features a method of applying a touch fastener assembly to a package, the method including unwinding a roll of mated and longitudinally spaced pairs of touch fastener patches carried between first and second longitudinally continuous release liners. Each pair includes a first patch peelably adhered to the first release liner and a second patch peelably adhered to the second release liner, the first patch having a leading edge disposed behind a leading edge of the second patch, in an unwind direction of the roll. The method further includes peeling back the first release liner to expose a first adhesive surface of the first patch of a mated pair. The method further includes permanently adhering the first adhesive surface to a first packaging surface, and peeling back the second release liner to expose a second adhesive surface of the mated pair. The method further includes bringing a second packaging surface into contact with the exposed second adhesive surface, to permanently adhere the second adhesive surface to the second packaging surface, with the mated pair forming a touch fastener assembly releasably connecting the first and second packaging surfaces.

In some cases, the second release liner is peeled back while the first adhesive surface is permanently adhered to the first packaging surface.

In some examples, peeling back the first and second release liners includes using a strip plate on each side of the fastener assembly, each plate having a flat surface in contact with a back surface of the release liners.

In some examples, the first release liner has a lower release resistance than a release resistance of the second release liner.

In some cases, permanently adhering the first adhesive surface includes pressing the pair of patches to the first packaging surface before peeling back the second release liner.

In some embodiments, the first patch has a width, in a direction across the release liners, that increases with distance from a leading end of the first patch.

In some cases, the first patch has an overall area that is less than an overall area of the second patch.

In some implementations, the first and second patches carry mating touch fastener elements opposite the adhesive surfaces, such that the first and second patches form releasably engaged fastening pairs defining touch fastening interfaces therebetween. In some cases, the touch fastening interfaces are configured to enable peeling of the first release liner while leaving the engaged fastening pairs adhered to the second release liner.

In some embodiments, the first and second release liners are peeled back before permanently adhering any of the first and the second adhesive surfaces. In some examples, the second release liner is peeled back after the first release liner to expose the second adhesive surface as the mated pair is ejected onto the second packaging surface to be permanently adhered to the second packaging surface.

Another aspect of the invention features a method of applying a touch fastener assembly to a package, the method including unwinding a roll of mated and longitudinally spaced pairs of touch fastener patches carried on a longitudinally continuous release liner. One patch of a pair of touch fastener patches has a leading edge, in an unwind direction of the roll, disposed behind a leading edge of another patch of the pair of touch fastener patches. The unwinding separates a first adhesive surface of each pair from the release liner while leaving the pair adhered to the release liner by a second adhesive surface. The method further includes permanently adhering the first adhesive surface to a first packaging surface, peeling back the release liner to expose the second adhesive surface, and bringing a second packaging surface into contact with the exposed second adhesive surface to permanently adhere the second adhesive surface to the second packaging surface. The mated pair of patches form a touch fastener assembly releasably connecting the first and second packaging surfaces.

In some cases, the release liner is peeled back while the first adhesive surface is permanently adhered to the first packaging surface.

In some examples, peeling back the release liner includes using a strip plate on one side of the fastener assembly, the plate having a flat surface in contact with a back surface of the release liner.

In some embodiments, the release liner is peeled back before permanently adhering any of the first and the second adhesive surfaces to a packaging surface. In some embodiments, the release liner is peeled back to expose the second adhesive surface as the mated pair is ejected onto the second packaging surface to be permanently adhered to the second packaging surface.

In some examples, at least one patch of the pair of touch fastener patches has a width, in a direction across the release liner, that increases with distance from a leading end of the patch.

In some implementations, one patch of the pair of touch fastener patches has an overall area that is less than an overall area of the other patch of the pair of touch fastener patches.

In some cases, at least one of the first and second adhesive surfaces includes a hot melt pressure sensitive tape.

In some examples, the patches with the first adhesive surface have a leading edge disposed behind a leading edge of the patches with the second adhesive surface, in an unwind direction of the roll.

In some examples, the patches of the pair of touch fastener patches carry mating touch fastener elements opposite the adhesive surfaces, such that the patches form releasably engaged fastening pairs defining touch fastening interfaces therebetween. In some cases, the touch fastening interfaces are configured to enable peeling of the release liner while leaving the engaged fastening pairs adhered to the first packaging surface.

Delivering pre-mated fastener patches on a wound roll to a package manufacturing line can be very useful in allowing the patches to be readily applied by standard equipment, such as labeling equipment. The mated strips of patches can be configured to help reliably and, in some cases, sequentially remove release liners to expose adhesive for bonding the patches to package substrate. For example, the release liners can be configured to peel at different peel loads, particularly without separating the mated patches. The patches can be advantageously shaped, particularly in the respective locations of the leading edges of mated patches, to peel one without peeling the other. Pairs of patches sandwiched between two liners can be readily produced using a master/slave electronic cam system with a registration sensor, to control the motion of a die-cut roll and produce a longitudinally continuous fastener assembly with aligned, engaged patches that can be wound to form a roll. The wound product can be shipped and is ready for use as a dispenser in a patch-application process. The release liners can be peeled back one at a time without disengaging the patches, allowing the assembly to be used with automated labeling equipment without requiring alignment of one applied patch to the other. In other cases, the mated pairs of patches can be provided on a single carrier strip that functions as a release liner to adhesive surfaces on both sides of a given pair, and which is peeled from one surface during unwinding of the roll, and subsequently from the other surface, such as after the pair has been permanently adhered to a packaging surface.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
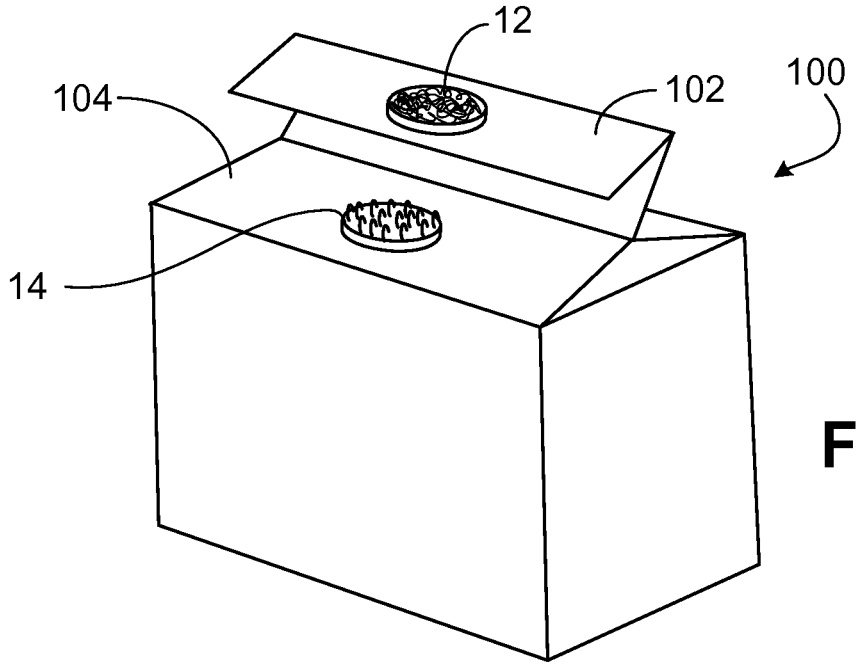
FIG. 1 is a perspective view of a package with fastener patches forming a package closure.

Referring to FIG. 1, a package 100 has two fastener patches 12 and 14 that engage to close package 100. Patches 12 and 14 have mechanical touch fastener features that engage to form a package closure. The fastener features of the patches enable a user to quickly open and close the package. Package 100 includes a flap 102 that folds to overlay a top surface 104 of package 100. The first patch 12 is attached to a surface of flap 102 and the second patch 14 is attached to the top surface 104 of the package such that when flap 102 is folded downward (i.e., toward patch 14), both patches are releasably engaged to hold package 100 closed. Package 100 could be any type of box, container, envelope, or case with a foldable flap or panel. As further discussed in detail with respect to FIG. 13, the patches are applied to package 100 by first unwinding a mechanical touch fastener assembly carrying mated patches, and then peeling back the patches from a release liner to adhere the patches to package 100.

Figure 2:
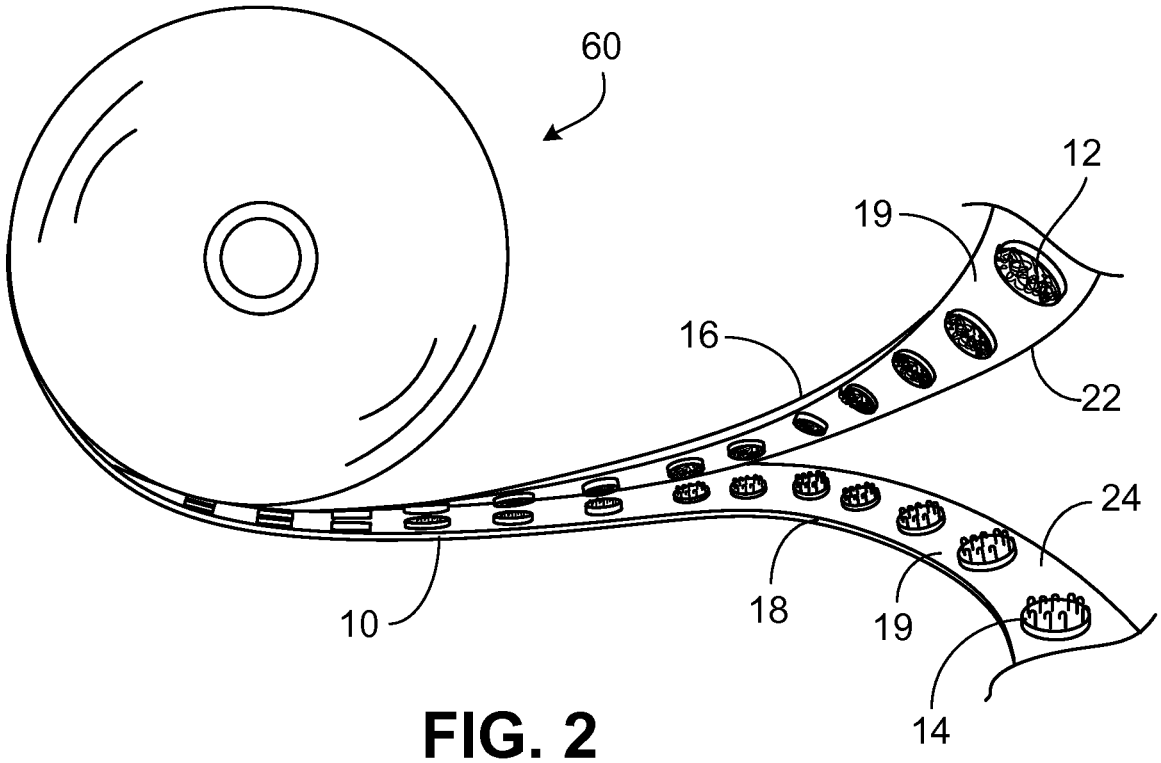
FIG. 2 is a schematic illustration of a longitudinally continues touch fastener assembly wound to form a roll or spool.
Figure 3:
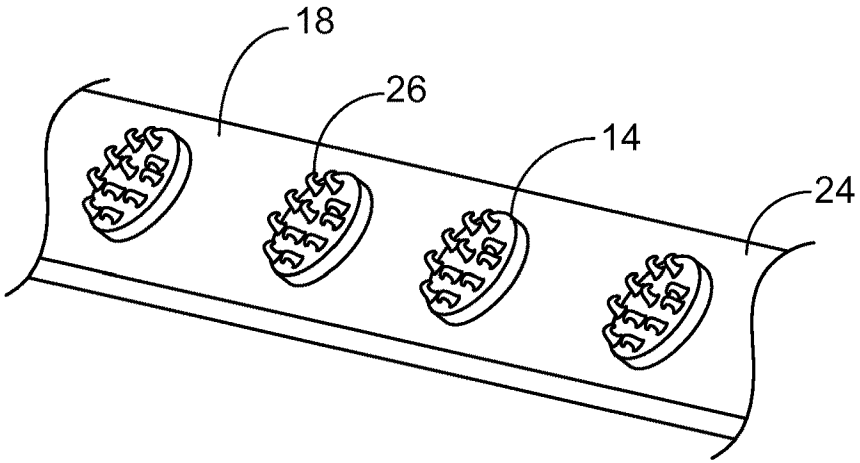
FIG. 3 is a perspective view of a section of a fastener product having spaced patches with discrete hooks.
Figure 4:
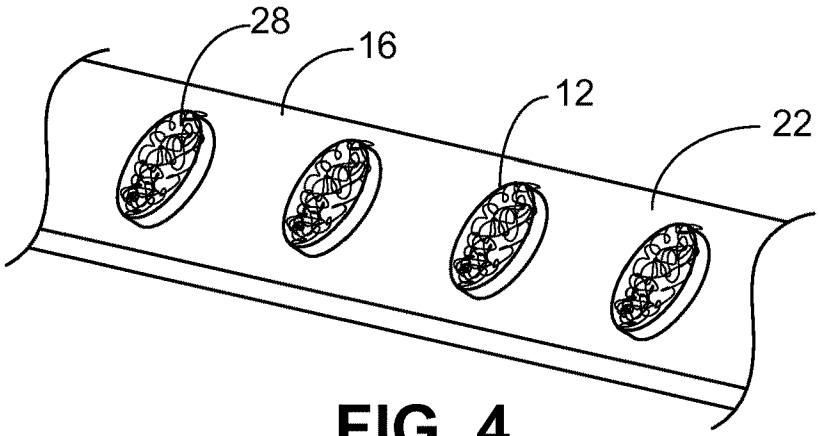
FIG. 4 is a perspective view of a section of a fastener product having spaced patches with fibrous loops.

FIG. 2 shows a wound mechanical touch fastener assembly 10 carrying multiple mated pairs of fastener patches 12 and 14. Fastener assembly 10 features two strips of longitudinally continuous tape 16 and 18 that sandwich a series of engaged patches 12 and 14. As wound, tape 16 is the 'inner tape', and tape 18 is the 'outer tape'. The patches are disposed in a row, spaced along the length of tapes 16 and 18 to expose a surface 19 of each tape between adjacent patches. Each patch has fastener features on a surface opposite the tape. Each patch 12 carried on first tape 16 corresponds and engages with a respective patch 14 of second tape 18 to form a mated hook-and-loop fastener assembly. Referring also to FIGS. 3 and 4, the fastener features of patches 14 are discrete hooks 26 and the fastener features of patches 12 are fibrous loops 28. The hooks could be of any shape designed to releasably engage fibers of the mating patch, such as J-shape, palm-tree or mushroom-type hooks. In the example shown in FIG. 2, patches 12 carried on first tape 16 (e.g., inner patches) have a fibrous surface 28, and patches 14 carried on second tape 18 (e.g., outer patches) have hooks 26 that engage the fibrous surface 28 of the first set of patches 12.

As shown in FIG. 2, tapes 16 and 18 can be flexible release liners 22 and 24, such as thin strips of paper or plastic-base liners. As further discussed in detail with respect to FIG. 5, release liners 22 and 24 cover the adhesive surfaces (not shown) of fastener patches 12 and 14. Release liners 22 and 24 have a release coating that prevents the adhesive surfaces of the patches from permanently sticking to the release liner, allowing the patches and adhesive to be removed together from the release liner by a peeling action. Each engaged pair of patches is disposed between the release liners 22 and 24, with the release liners wound to form roll 60. Patches 12 and 14 are all of oval shape, elongated in a direction across the release liner. The arrangement and shape of patches 12 and 14 facilitate the removal of the release liners 22 and 24 during the patch-application process. For example, because the separation resistance of the engaged patches 12 and 14 is significantly greater than the release resistance of the release liners 22 and 24, the liners can be quickly peeled back from the patches while the patches remain engaged. In addition, by positioning patches 12 and 14 with their long axis across the release liners (as opposed to placing the patches with their long axis along the length of the release liners), roll stability during shipment can be increased.

Figure 5:
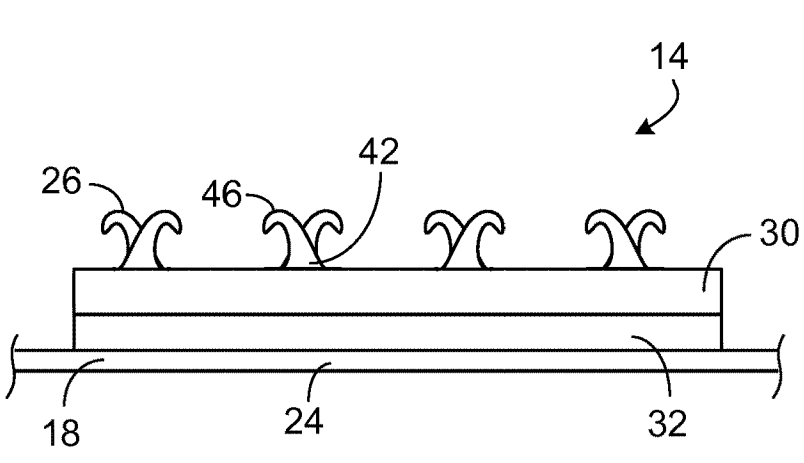
FIG. 5 is a side view of a fastener patch with discrete, fiber-engaging hooks.

Referring now to FIG. 5, fastener patch 14 has a field of discrete, spaced-apart fastener hooks 26 that extend from a common layer of resin. Hooks 26 have discrete resin stems 42 and crook portion 46 configured to engage the fibrous loops of an adjacent loop patch. The hooks in this example are illustrated as J-hooks facing in alternate directions, but the hooks could be of any fiber-engaging shape such as palm tree or mushroom-type fastener elements. One suitable palm tree hook is HTH847, available from Velcro USA Inc. The common layer is in the form of a thin base 30 that extends across the entire area of patch 14. Base 30 may have a thickness of only about 0.15 mm, for example. The hooks 26 and base 30 together form one contiguous resin mass, the stem 42 of each hook 26 integrally molded with and extending from an outer surface of the base, such as by the process described by Fischer in U.S. Pat. No. 4,775,310, the contents of which regarding fastener structure and forming methods are hereby incorporated herein by reference. The hook strip can be formed directly on the release liner, such as by first coating the release liner with a relatively high temperature, pressure-sensitive adhesive before running the release liner into the nip with the hook-forming resin. Patch 14 has an adhesive layer 32 between resin base 30 and tape 18 (release liner 24). The adhesive layer can have a coating weight of about 35 grams per square meter, for example. In some examples, adhesive layer 32 is applied between the resin base and the release liner as a double-sided adhesive tape such as a hot melt pressure sensitive adhesive (PSA) tape or a double-coated polyester (PET) film. Adhesive 32 may have a thickness of about 10 to 200 micrometers, for example.

Figure 6:
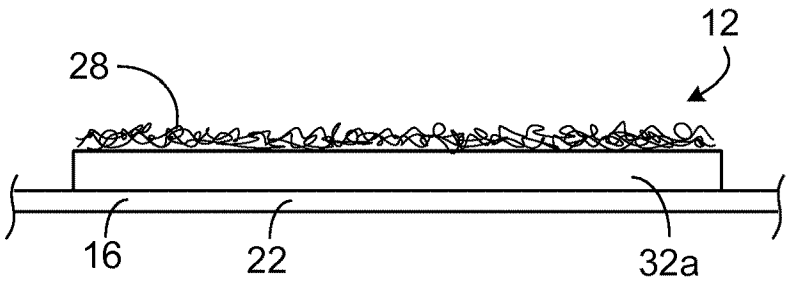
FIG. 6 is a side view of a fastener patch with fibrous loops.

Referring to FIG. 6, fastener patch 12 has a field of fibrous loops 28 extending from an adhesive layer 32*a* that connects loops 28 to tape 16. Fibrous loops 28 can be of a non-woven material adhered to and/or embedded in adhesive layer 32*a*. Adhesive layer 32*a* may be applied between the loop material and the release liner as a double-sided hot melt PSA tape or a double-coated polyester (PET) film. Alternatively, a non-woven material may be first laminated to a film, such as a 30 micron polyethylene film, that is then laminated to a double-sided adhesive tape.

Other forms of hook and loop materials may be employed. For example, either or both of the hook and loop surfaces can be formed of woven hook and loop material, embedded in adhesive or another backing material supporting an adhesive layer for securing the patches to packaging material.

Figure 7:
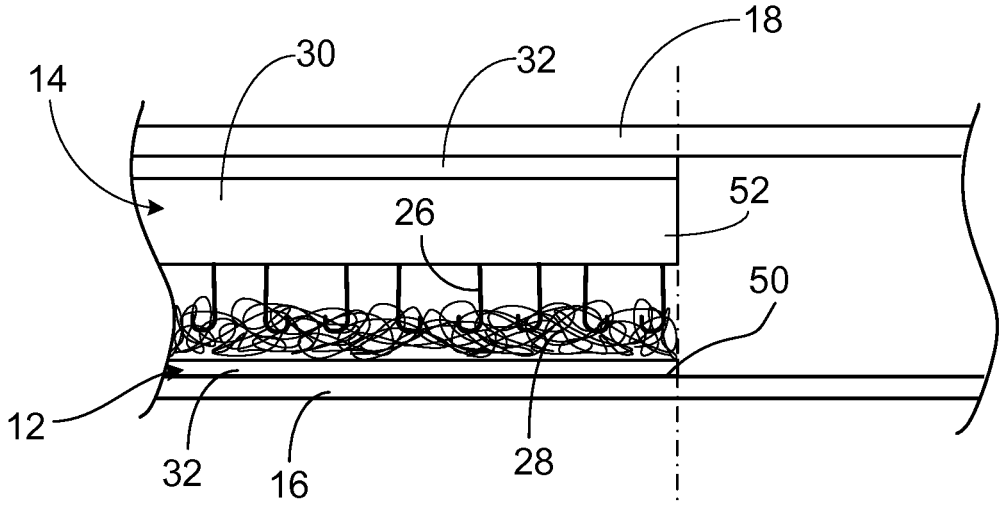
FIG. 7 is an enlarged, side view of a section of two releasably engaged hook and loop patches.

FIG. 7 illustrates a pair of engaged fastener patches 12 and 14 sandwiched between tapes 16 and 18. Tapes 16 and 18 may be in a wound or unwound state. The peel resistance between patches 12 and 14 is greater than the peel resistance of the light adhesive connection between each patch and its carrying tape 16 and 18, such that when tapes 16 and 18 are peeled back from patches 12 and 14, the patches remain engaged. The stiffer the patches are, the easier it is to peel back the release liners. Preferably, the two engaged patches 12 and 14 together form a relatively stiff assembly that avoids significant flexure as the release liners are quickly peeled back. In some cases, tape 18 is chosen to be peeled from the hook fastener patch 14 before tape 16 is peeled, and in such cases the hook fastener patch can be formed to provide greater resistance to bending than the loop fastener patch. In FIG. 7 the two engaged patches 12 and 14 have aligned leading edges 50 and 52 that end at a common point along the length of the tapes. Tape 18 is peeled back from patch 14 in a direction starting at leading edge 52 and then moving away from edge 52 along the length of the tape (i.e., moving to the left in the figure, as the patches move to the right). Fastener patches 12 and 14 can each have the same peripheral shape (e.g., oval or elliptical) and may be engaged such that when their leading edges are aligned, their peripheral edges may also coincide. A package can be more aesthetically pleasing if its package closure is formed with two aligned patches of identical shape.

Figure 7A:
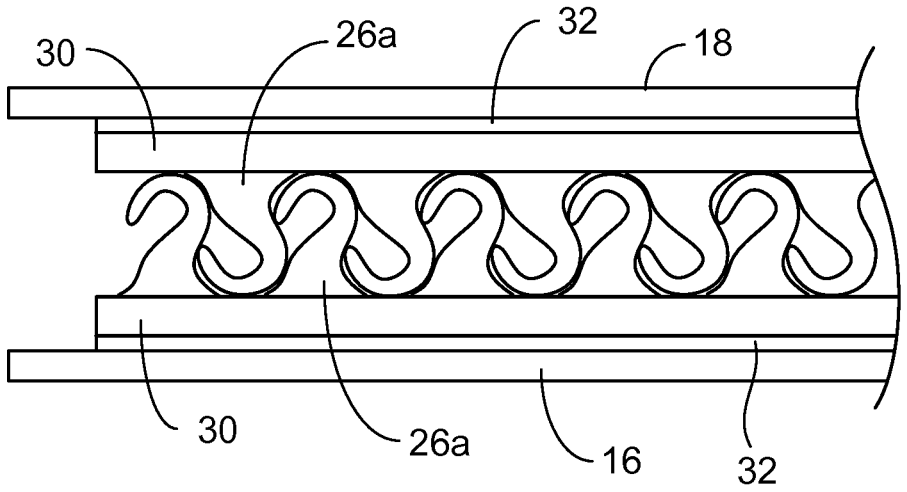
FIG. 7A is an enlarged, side view of a section of two releasably engaged hook patches.

FIG. 7A shows two mated fastener coins each carrying an identical array of self-engaging fastener hooks 26*a*, pressed together to form a releasable fastening. The details of such hooks and their manufacture can be found in U.S. Pat. No. 8,225,467, the contents of which are incorporated herein by reference.

Figure 8:
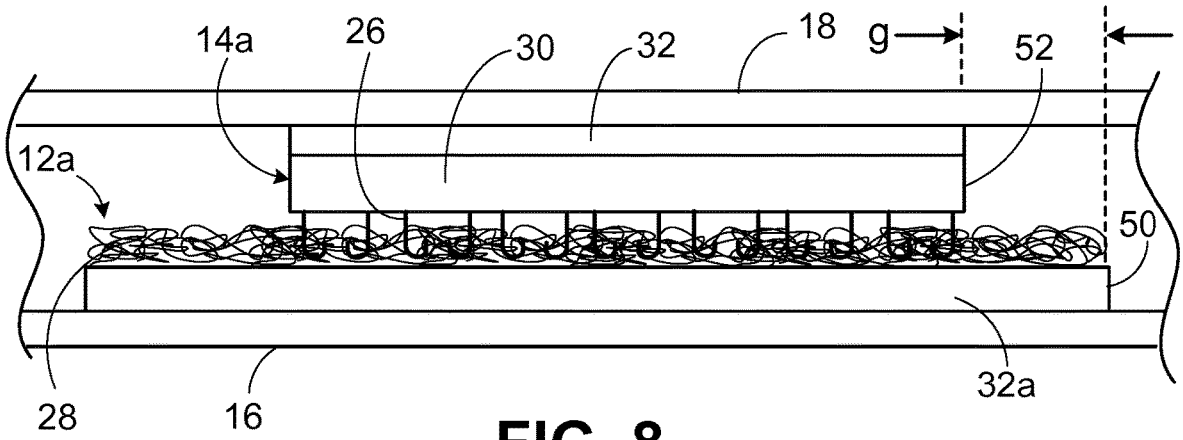
FIG. 8 is a side view of two releasably engaged patches having different sizes.

As shown in FIG. 8, two engaged patches 12*a* and 14*a* of different sizes are engaged and sandwiched between tapes 16 and 18. Other than relative positioning and size, the patches of FIG. 8 are of identical structure as the patches of FIG. 7. Outer patch 14*a* has a leading edge 52 that is disposed behind leading edge 50 of inner patch 12*a* in an unwind or processing direction of the roll. The lag distance 'g' between the leading edges in the processing direction is about 3-5 millimeters. One effect of this lag distance is that as outer tape 18 is peeled back from outer patch 14*a*, the peel load applied to the outer patch is initially at leading edge 52 and progresses rearward. This initial peel load is transferred from the outer patch to the inner patch at the leading edge of the outer patch, which is engaged with the inner patch rearward of its leading edge. Therefore, due to the flexibility of the materials, this initial peel load is resisted not only by the peel resistance between the inner patch 12*a* and inner tape 16, but also by the shear resistance between the inner patch and the inner tape over the area of inner patch 12*a* that is forward of the leading edge 52 of the outer patch. This shear resistance may be, translated into an equivalent load applied at the leading edge of the outer patch, significantly higher than the peel resistance. In this way, arranging the patches such that the inner patch leading edge leads that of the outer patch by even a small lag distance can have a significant effect on the ease of peeling off the outer release liner without inadvertently separating the inner patch from its release liner. Alternatively or in addition, the product can be configured such that the adhesion of tape 18 has a lower peeling resistance than that of tape 16.

Outer patch 14*a* also, in this example, has a smaller overall area than that of inner patch 12*a*, with a small width of the inner patch exposed beyond the edge of outer patch around an entire periphery of the outer patch. This can help to ensure that the release load of the fastener on the package is not reduced by slight movement of the relative positioning of the patches in use, as all of the effective fastening area of the smaller patch will overlap the larger patch for engagement.

Figure 9:
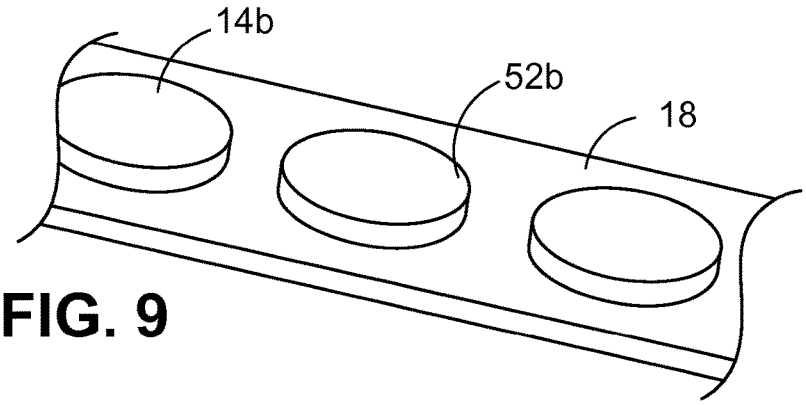
FIG. 9 is a perspective view of a section of a fastener product having fastener patches shaped as elongated circles.
Figure 10:
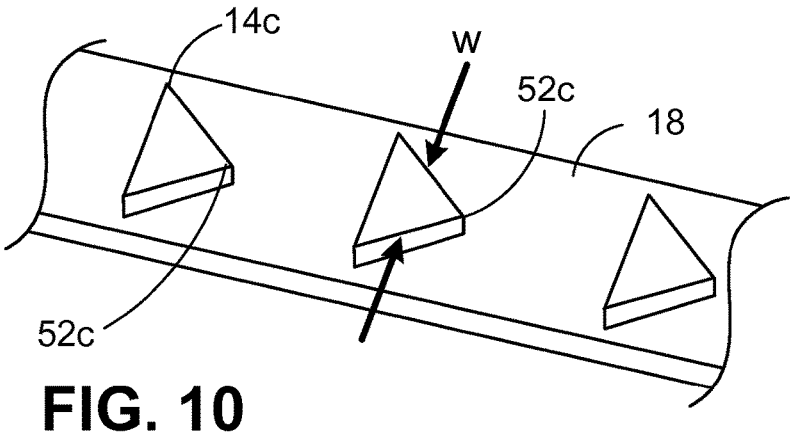
FIG. 10 is a perspective view of a section of a fastener product having fastener patches shaped as triangles.

FIGS. 9 and 10 illustrate a tape 18 with hook patches 14*b* and 14*c* having different shapes and arrangements. Hook patches 14*b* and 14*c* are engaged with loop patches (not shown) that have the same or similar shape. The shape of the patches remains generally unchanged when the tapes carrying the patches are wound to form a roll. FIG. 9 shows a tape 18 with patches 14*b* that have an elongated circular shape extending parallel to tape 18, with the narrow end of the patch (e.g., the vertex) positioned as the leading edge 52*b*. Such arrangement can improve the peeling performance of tape 18 due to the relatively small engagement width of the leading edge 52*b*. For example, compared to the arrangement shown in FIG. 3, a small width of the patch 14*b* is engaged with the tape 18 at the leading edge 52*b*, decreasing the adhesive resistance between the tape and leading edge 52*b*. Such arrangement can be useful in applications where the release resistance between the engaged patches is very low.

Other variations in size and shape are envisioned. For example, the shapes of the two mating patches may be selected to suggest their cooperative function, such as making them of associated shapes. They may also be die-cut in the shape of logos, or text, or to have other functional attributes.

FIG. 10 illustrates a tape 16 with fastener patches 14*c* that have a generally triangular shape. Patches 14*c* have a width 'w' in a direction across the tapes that increases with distance from leading edge 52*c*. Because leading edge 52*c* is one of the corners of the triangle patch 14*c*, leading edge 52*c* has an even smaller engagement width in contact with the tape 18 than the patch in FIG. 9, significantly reducing the adhesive force between the patches and the tape. Promoting the peel of tape 18 from patches 14*c* without causing the peel of the other tape can be further improved by forming the mated loop patch (not shown) to have a wider leading edge than leading edge 52*c*. A loop patch with a relatively wide leading edge will have a higher initial adhesive peel resistance. This ensures that the loop patch remains engaged to its tape as the tape 18 is being peeled back from the small leading edge 52*c*.

Figure 11A:
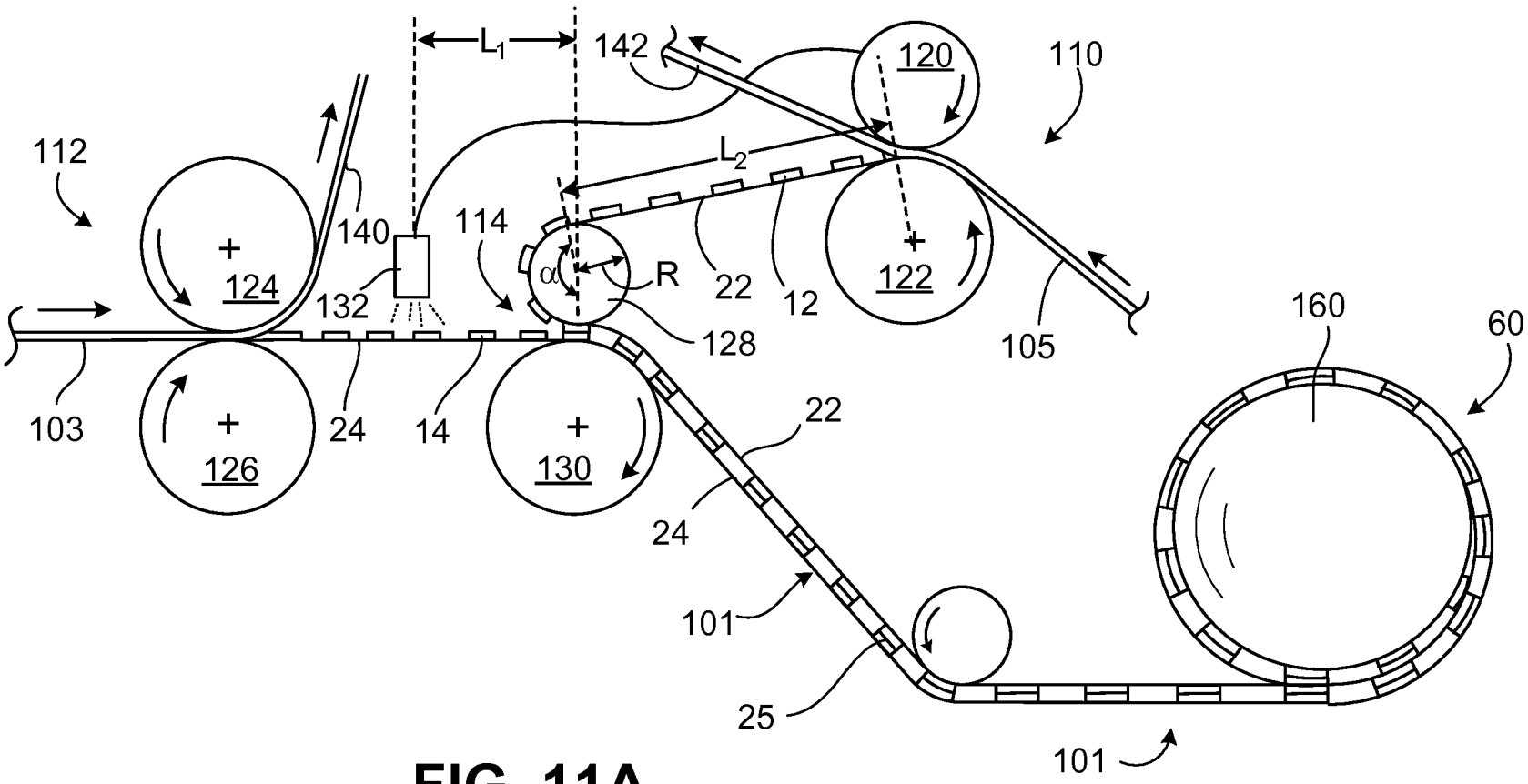
FIG. 11A is a schematic illustration of an apparatus and method of forming a touch fastener assembly according to a first implementation.

Referring to FIG. 11A, a method and apparatus for manufacturing a fastener product 101 features two die-cutting stations 110 and 112, a registration sensor 132, a marriage station 114, and a roll-winding station 160. The die-cutting stations each include two counter-rotating rolls: a die-cut roll and an anvil roll. Each die-cut roll 120 and 124 has a diameter of about 150 millimeters.

Registration sensor 132 senses the presence of patches 14, from which the speed of the tape and the position of each leading edge can be derived. Die-cut station 110 is controlled as a function of the sensed position and speed of patches 14. More specifically, die-cut station 110 is controlled with respect to signals received from sensor 132, to cut patches 12 at a position along tape 22 that is related to the position of patches 14 along tape 24.

Two materials 103 and 105 are introduced to respective die-cutting stations 112 and 110 where they are cut to form hook patches 14 and loop patches 12 respectively. The first material 103 includes three layers of material (shown in FIG. 5): a strip of release liner (as a base), a strip of PSA tape, and a strip of resin hook material with a continuous base carrying fastener hooks. The resin base is adhered to the release liner by the PSA tape. At the die-cut station 112, the fastener hooks face die-cut roll 124 and the release liner faces anvil roll 126. As material 103 passes through station 112, die-cutting station 112 first kiss cuts, through the resin base and the PSA tape, a patch shape. Then, a matrix waste 140 is stripped off from release liner 24 and discarded, leaving a series of spaced-apart patches 14 carried on release liner 24. The second material 105 includes three layers (shown in FIG. 6): a strip of release liner, a strip of PSA tape, and a layer of fibrous loops. The fibrous loops face die-cut roll 120 and the release liner faces anvil roll 122. Die-cutting station 110 first kiss cuts, through the fibrous loops and the PSA tape, a patch shape. Then, a matrix waste 142 is stripped off from release liner 22 and discarded, leaving a series of spaced-apart patches 12 carried on release liner 22.

Once the patches 12 and 14 have been formed, the two release liners 22 and 24 carrying the patches advance to marriage station 114. Marriage station 114 brings patches 12 and 14 together into fastening engagement, by pressing the tapes between counter-rotating rolls 128 and 130. The engaged patches sandwiched between respective release liners 22 and 24 form a mated, longitudinally continuous fastener assembly 101 with releasably engaged patch pairs 25. Fastener assembly 101 is then wound to form a roll 60 for shipment as a continuous fastener assembly.

Die-cutting station 110 can be controlled using a master/slave electronic cam system. For example, die-cutting station 112 is a master station and die-cutting station 110 is a slave station controlled to move as a function of movement at master station 112 (and not vice versa). Master station 112 can be set up to cut and advance patches 14 at a predetermined longitudinal spacing and speed. For example, master station 112 can cut patches at a distance of about 5 millimeters between each patch, equating to a patch pitch of 35 millimeters, and advance the tape 24 at about 15 meters per minutes. Registration sensor 132 then generates data by sensing patches 14 and sending that data to slave station 110 to continually adjust the speed of station 110, which then uses the sensor data to match the speed of the master station. Thus, as the speed of master station 112 changes, the speed of slave station 110 also changes. Slave station 110 is spaced from marriage station 114 by a distance '$L_2$' along the length of tape 22. Sensor 132 is spaced from marriage station 114 by a distance '$L_1$' along the length of tape 24. Distance '$L_1$' is about 0.5 meter. Preferably, the distance the tape passing through the slave station travels from die cutting to marriage is the same as the distance the tape passing through the master station travels from sensing to marriage. In other words, [$L_1=L_2+\alpha R$, where $\alpha$ is the wrap about the marriage roll 128 and R is the radius of the marriage roll. In this case, the tapes should be generally inelastic, or have an equivalent elasticity.

Registration sensor 132 is mounted above patches 14 to sense the position and speed of the patches. Sensor 132 can determine the position of patches 14 by sensing a registration mark (not shown) near each patch, or by sensing a visual or proximity contrast between the patches 14 and the release liner 24, for example. Sensor 132 continuously sends the gathered data to slave die-cut station 110. Slave station 110 includes a controller and two servomotors (not shown) that together control the speed and position of die-cut roll 120 and the speed of anvil roll 122. One servomotor drives die-cut roll 120 to control the distance between patches 12, and the other servomotor drives anvil roll 122 to control the speed of material 105, as further explained in detail below.

Figure 11B:
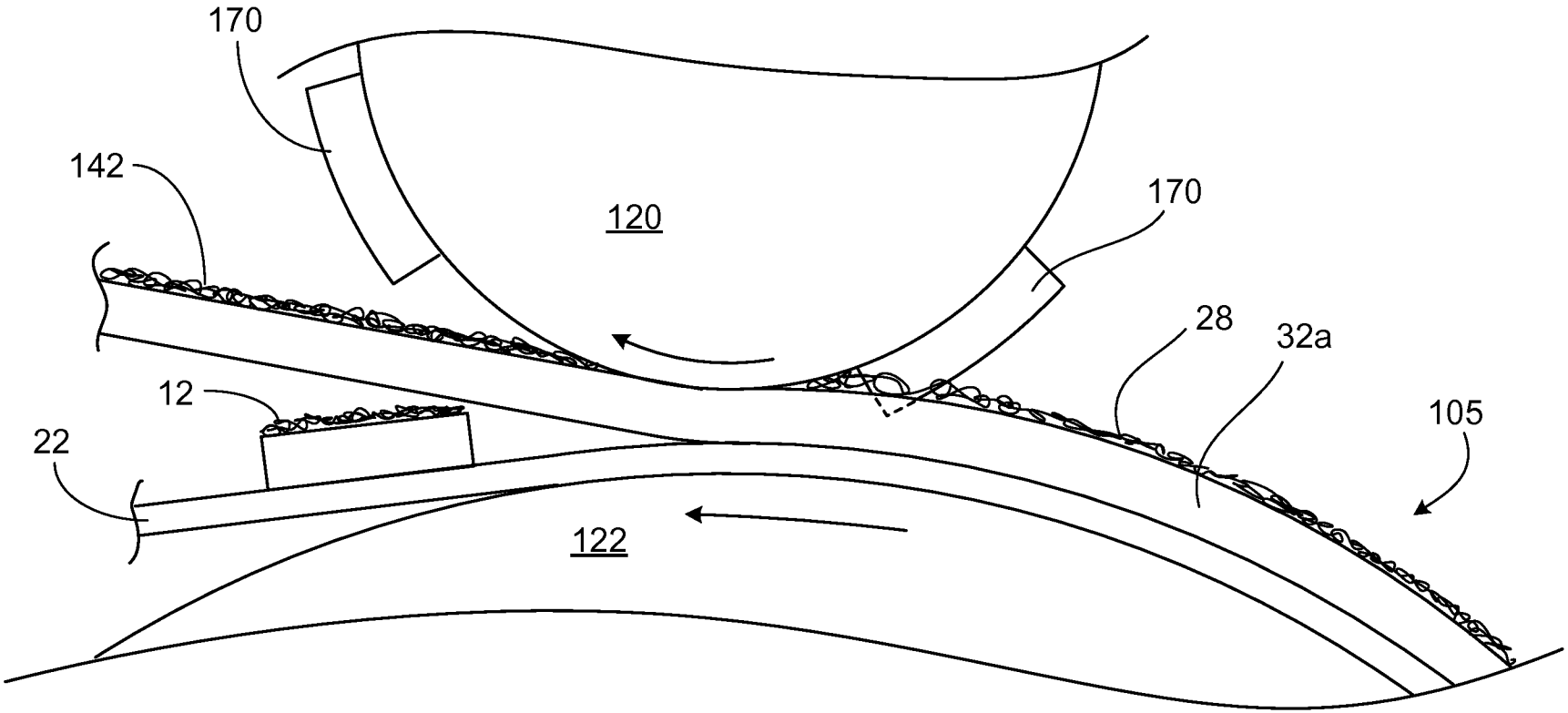
FIG. 11B is an enlarged view of a section of the apparatus shown in FIG. 11A.

The controller receives the sensor data from registration sensor 132 and uses an electronic cam to determine the speed at which slave station 110 should operate. An electronic cam is a motion profile or a mathematical relationship between the velocity/position of patches 14 and the velocity/position of slave die-cut station 110. In some arrangements, the electronic cam is configured to cut patches 12 at a position such that when patches 12 and 14 are engaged, patches 14 have a leading edge disposed behind a leading edge of patches 12 in an unwind direction of the roll. The controller is connected to and controls both servomotors that drive die-cut roll 120 and anvil roll 122. Die-cut roll 120 can be retarded or advanced by the servomotor to increase or decrease the distance between patches 12 along release liner 22. Referring also to FIG. 11B, die-cut roll 120 has rotary dies or blades 170 along its periphery extending from its surface. The rotary dies 170 have a patch shape for kiss cutting patches at the exact tolerances needed. Each die 170 cuts through the loops 28 and adhesive layer 32*a* to separate a loop patch 12 from the surrounding material. Die-cut roll 120 engages material 105 only when a rotary die 170 cuts through material 105, allowing material 105 to be advanced or retarded when a rotary die 170 is not engaged with the material. Anvil roll 122 engages material 105 as the material wraps around a portion of anvil roll 122, which enables anvil roll 122 to control the speed of material 105 to match the speed of material 103. In general, whenever a die 170 is engaged with the material the speed of die-cut roll 120 will match the speed of anvil roll 122. Between die engagements, die-cut roll 120 can slide on the surface of the material. During these non-cutting periods, the servomotor controlling roll 120 can cause the roll to accelerate or decelerate so as to adjust the position of the patches 12 on tape 22. The patches may also be die-cut by laser. Suitable die-cutting equipment components are available from Deltamodtech of Minneapolis, MN, for example.

In some examples, the outer release liner 24 is chosen to be slightly more elastic than the inner release liner 22, to compensate for the accumulated difference in circumferential length when wound as roll 60. Roll 60 may be wound as a single-width roll, or as a cross-wound spool, and may or may not include a bobbin or core on which the material is wound. If the patches are sufficiently thin, the roll may be wound to be stable without noticeable buckling or wrinkling of the inner liner. Using an elastic release liner may allow outer patches 14 to be released by progressive shear rather than peel, during application to packaging material. In such cases, release liner 24 can be removed without applying any peel that might tend to peel the inner patches from their release liner. In some examples, to prevent progressive shear from separating the patches from the release liners, release liner 22 matches the elasticity of patches 12, and release liner 24 matches the elasticity of patches 14. Release liners 22 and 24 can each be made to have a different adhesive peel resistance from the adhesive on the back side of the patches.

Figure 12:
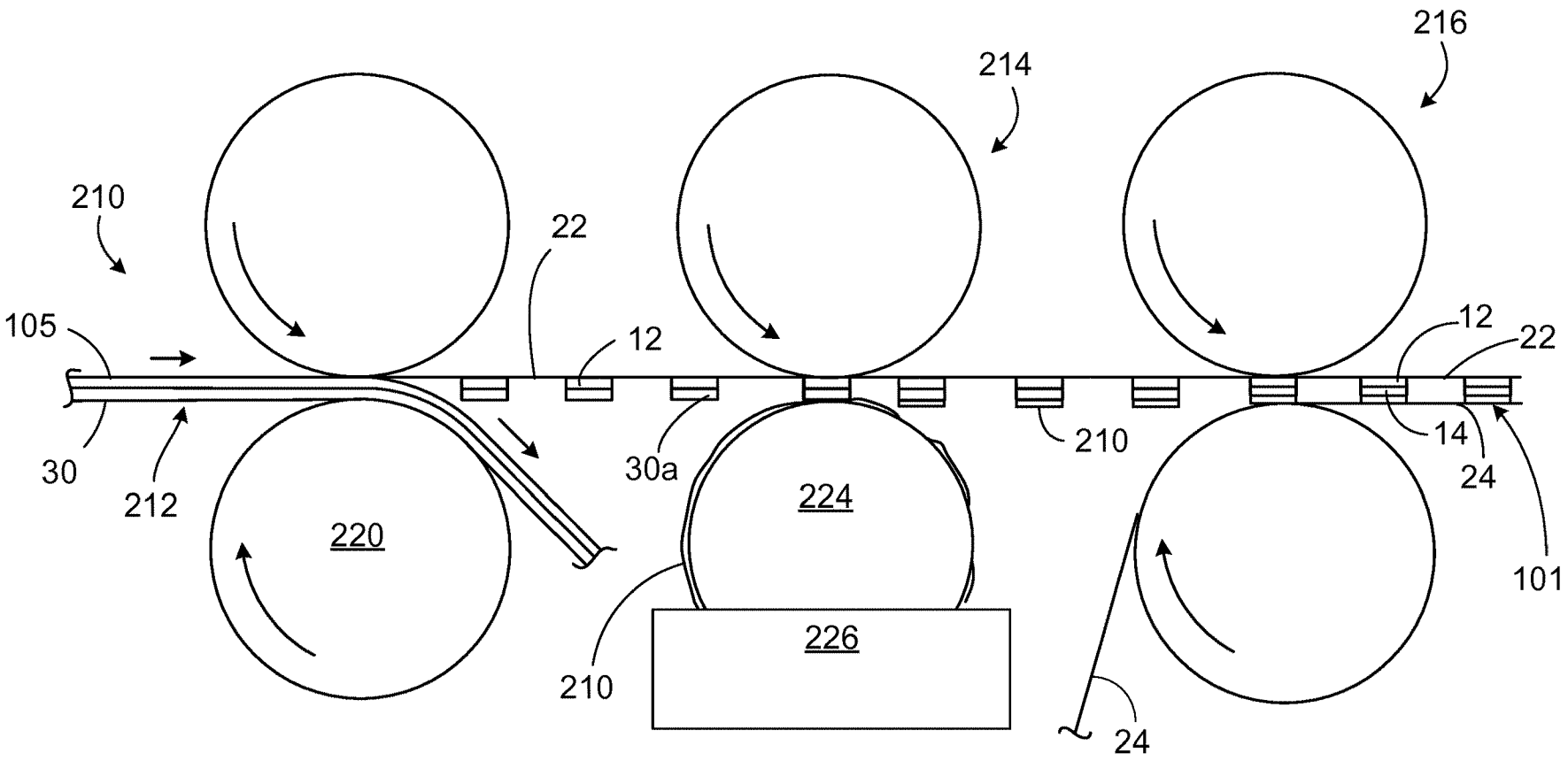
FIG. 12 is a schematic illustration of an apparatus and method of forming a touch fastener assembly according to a second implementation.

Referring now to FIG. 12, a different method and apparatus for manufacturing fastener product 101 feature only one die-cutting station 210. This method does not use a master/slave cam system and does not use a registration sensor. Die-cutting station 210 is similar to the die-cutting stations in FIG. 11A, with the main difference being that die-cut roll 220 kiss cuts through two strips of touch fastener material that are already releasably engaged. Material 212 includes two longitudinally continuous and parallel strips of touch fastener material that have been brought into releasable engagement to form a tape assembly. More specifically, material 212 includes (1) a strip of resin base 30 with fastener hooks and (2) the three-layer material 105 carrying fibrous loop that is shown in FIG. 11B. The fastener hooks of resin base 30 are engaged with loops of material 105. Die-cut roll 220 cuts through resin base 30, through the fibrous loop layer, and through the PSA layer of the bottom material 105, leaving discrete, longitudinally spaced apart patches 12 engaged with coins 30*a*, all carried on release liner 22. A matrix waste 240 is stripped off from release liner 22 for disposal or recycling. Patches 12 and mated coins 30*a* are advanced to an adhesive-application station 214, where a roll 224 carrying a liquid adhesive 210 such as an acrylic from an adhesive container 226 applies the adhesive 210 to the exposed back surfaces of coins 30*a* to form adhesive-backed fastener hook patches 14. The engaged patches 12 and 14 are then advanced to a release-liner application station 216 in which a release liner 24 is applied to patches 14 to cover adhesive 210 while the adhesive is still flowable. If using a water-based adhesive, the material can be passed through an oven prior to applying the release liner. Station 214 can be a rotary screen printer. As an alternative, the adhesive can be printed on an upper surface of coins on the tape, by a controlled printer. Patches 12 and 14 are thus sandwiched between release liners 22 and 24 to form a longitudinally continuous touch fastener assembly 101. Fastener assembly 101 is wound to form a roll (as in FIG. 11A) for shipment as a continuous fastener assembly.

Alternatively, patches 12 and 14 can be formed without station 216, and rolled with only one release liner, provided on both sides with a surface that is peelable from the adhesive. After application of the adhesive to the exposed back surfaces of coins 30*a*, the adhesive is allowed to solidify and/or cure to form adhesive-backed hook patches 14 and the product is wound such that the adhesive engages the back surface of the release liner of the previous winding or course. As the tape is unrolled for use, the adhesive back surfaces of the hook patches are peeled from the release liner and exposed to be permanently adhered to a packaging surface. Alternatively, patches 12 and 14 can be formed and rolled with one release liner using a different method (not shown) that includes a master/slave cam system similar to the method in FIG. 11A. For example, after the two release liners 22 and 24 carrying the patches are brought together in the marriage station, one release liner 24 can be peeled back to expose the adhesive surface of patches 14, leaving the engaged patches 12 and 14 on release liner 24. After peeling back release liner 24, the product is wound such that the adhesive of patch 14 engages the back surface of the release liner 22 of the previous winding or course. Additionally, patches 12 and 14 can be engaged in an offset configuration (e.g., patches 14 having a leading edge disposed behind a leading edge of patches 12) before peeling back release liner 24.

Figure 13:
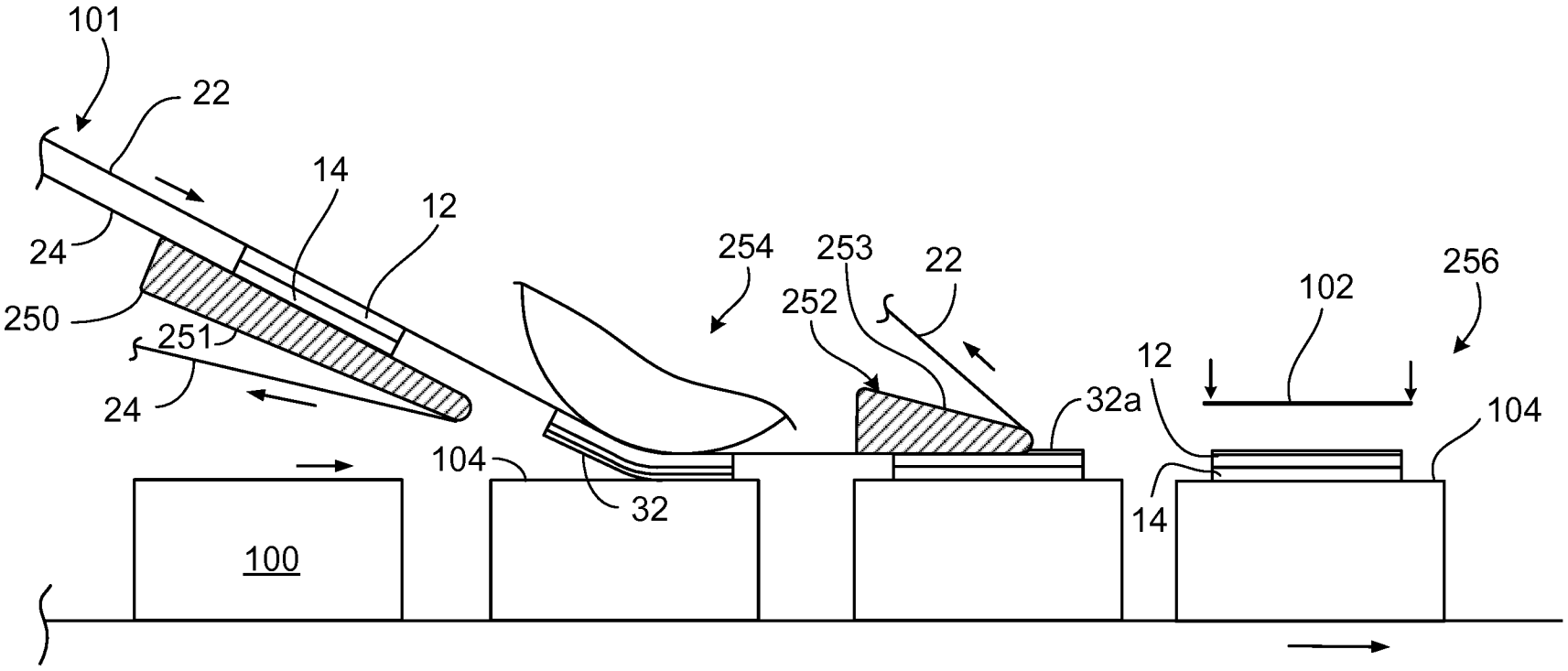
FIG. 13 is a schematic illustration of an apparatus and method of applying the mated fastener assembly to a package.

Referring to FIG. 13, a method and apparatus for applying fastener patches 12 and 14 to a package 100 features two strip stations 250 and 252 and two application stations 254 and 256. Fastener assembly 101 is unwound and advanced to a first strip station 250 where a strip plate 251 is used to remove release liner 24 from fastener hook patches 14 to expose the PSA tape 32 under patch 14. The engaged patches remain adhered to release liner 22. Engaged patches 12 and 14 are then advanced to a first application station 254 in which a roll presses patch 14 against a top surface 104 of package 100 to permanently adhere patch 14 to surface 255. Mated patches 12 and 14 are then advanced, with patches 14 permanently adhered to package 100, to a second strip station 252 where a strip plate 253 is used to remove second release liner 22 from patch 12 to expose PSA tape 32*a*. The engaged patches, adhered to package 100, are then advanced to a last application station 256 in which a flap 102 of package 100 is pressed against patches 12 to permanently adhere flap 102 to patch 12. Thus, patches 12 and 14 form a touch fastener assembly that releasably connects the flap 102 to top surface 104 of package 100. In the case where the fastener product is wound on only one release liner, the product can be introduced directly to station 254.

Release liner 24 may have a lower release resistance than release liner 22 to allow the engaged patches to remain adhered to release liner 22 when release liner 24 is being stripped off. In some examples, as discussed with respect to FIGS. 8-10, patches 14 may have a leading edge that decreases the release resistance of liner 24. Release liners 22 and 24 can each be made of a different material and have a different adhesive resistance to differentiate the peel resistance of the liners during the automated patch-application process.

Figure 14:
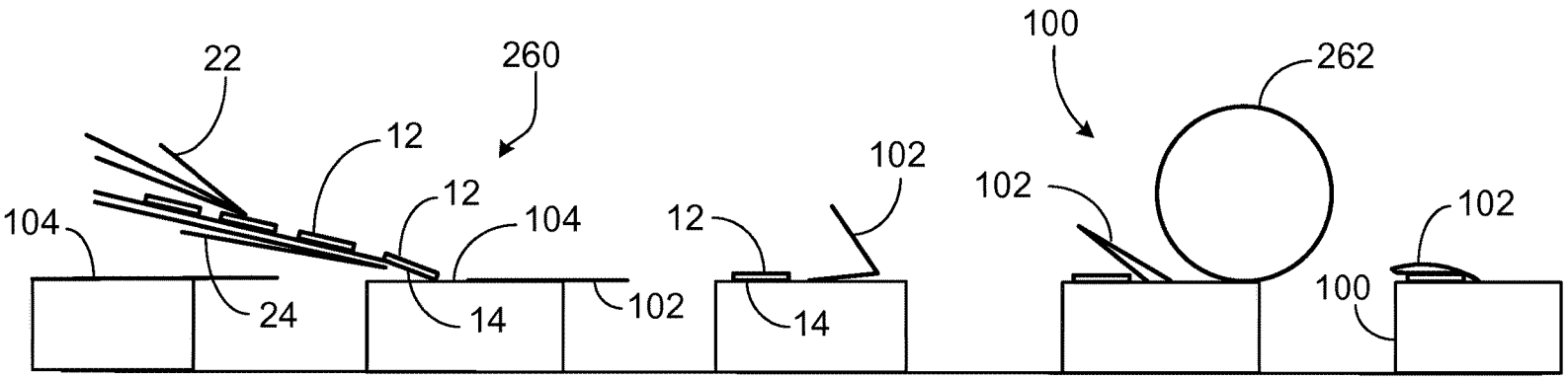
FIG. 14 is a schematic illustration of another apparatus and method of applying the mated fastener assembly to a package.
Figure 15:
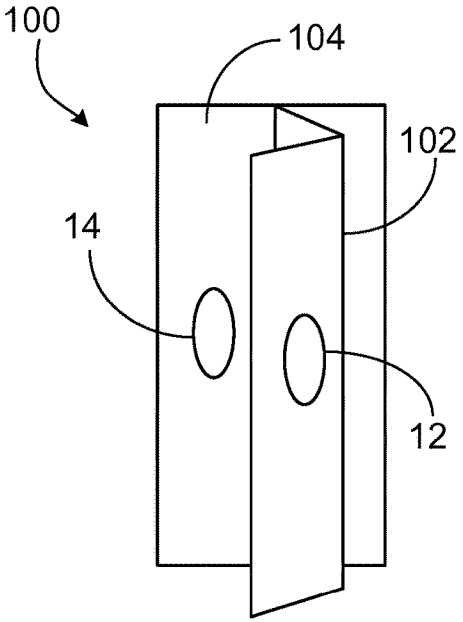
FIG. 15 is a top view of the package of FIG. 1, with the fastener patches unfastened.

A similar application process is illustrated in FIG. 14, for placing mated fastener patches onto packages 100 with folded flaps 102 as shown in FIG. 1. Progressing from left to right, the upper release liner 22 is first peeled away to expose the adhesive upper coin surface. Then the exposed coin 12, 14 is further advanced on the lower release liner 24 to the application station 260, where the lower release liner is peeled back to expose the lower coin surface as the coin is ejected onto the upper surface 104 of the package. After the coin is in place, the upper flap 102 is folded and pressed into engagement with the exposed adhesive surface of the coin, such as by action of roller 262, thereby securing the flap 102 in its folded position until released by separating the mated fastening surfaces. The finished package 100, after separation of the fastening surfaces and the partial unfolding of flap 102, is shown in FIG. 15.

The mated coins can also be fed on the release liners into a vertical form-and-fill (VFF) process, for attachment to bag film in the process of making and filling bags, such that the mated coins become a means for releasably opening and/or reclosing the filled bags.

While a number of examples have been described for illustration purposes, the foregoing description is not intended to limit the scope of the invention, which is defined by the scope of the appended claims. There are and will be other examples and modifications within the scope of the following claims.

What is claimed is:

1. A mechanical touch fastener assembly comprising:

a first longitudinally continuous tape carrying a series of first fastener patches on a surface thereof, the first patches arranged in a row along a length of the first tape and carrying a field of first touch fastening features on a surface opposite the first tape, each first patch longitudinally spaced from adjacent first patches such that the first tape surface is exposed between the first patches; and a second longitudinally continuous tape carrying a series of second fastener patches on a surface thereof, the second patches arranged in a row along a length of the second tape and carrying a field of second touch fastening features on a surface opposite the second tape, each second patch longitudinally spaced from adjacent second patches such that the second tape surface is exposed between the second patches;

wherein the first tape comprises a first release liner covering adhesive surfaces of the first fastener patches, and the second tape comprises a second release liner covering adhesive surfaces of the second fastener patches, the first and second tapes being wound together to form a roll, with each of the first fastener patches releasably engaged to a respective one of the second fastener patches by inter-engagement of the first and second touch fastening features, and with the engaged fastener patches disposed between the first and second release liners; and wherein as wound to form the roll, one patch of an engaged pair of first and second fastener patches has a leading edge disposed behind a leading edge of another patch of the engaged pair of first and second fastener patches, in an unwind direction of the roll.

2. The assembly of claim 1, wherein one of the field of first touch fastening features and the field of second touch fastening features comprises an engageable fibrous surface, and the other of the field of first touch fastening features and the field of second touch fastening features comprises a field of discrete hooks configured to engage the engageable fibrous surface.

3. The assembly of claim 2, wherein the engageable fibrous surface comprises a non-woven material.

4. The assembly of claim 2, wherein the hooks have discrete resin stems extending from a common layer of resin extending across and forming a base of a corresponding patch.

5. The assembly of claim 1, wherein the field of first touch fastening features and the field of second touch fastening features comprise complementary arrays of hooks arranged to releasably engage when pressed together.

6. The assembly of any of claim 1, wherein as wound to form the roll, the patch having leading edge disposed behind the leading edge of the other patch is an outer patch of the engaged pair of first and second fastener patches.

7. The assembly of claim 1, wherein as wound to form the roll, at least one patch of an engaged pair of first and second fastener patches has a width, in a direction across the tapes, that increases with distance from a leading end of the outer patch.

8. The assembly of claim 1, wherein as wound to form the roll, one patch of an engaged pair of first and second fastener patches has an overall area that is less than an overall area of another patch of the engaged pair of first and second fastener patches.

9. A method of applying a touch fastener assembly to a package, the method comprising: unwinding a roll of the mechanical touch fastener assembly of claim 1, the first patches peelably adhered to the first release liner and the second patches peelably adhered to the second release liner, in an unwind direction of the roll;

peeling back the first release liner to expose the adhesive surface of the first patch of a mated pair;

permanently adhering the first adhesive surface to a first packaging surface;

peeling back the second release liner to expose the adhesive surface of the second patch of the mated pair; and bringing a second packaging surface into contact with the exposed second adhesive surface of the second patch, to permanently adhere the second adhesive surface of the second patch to the second packaging surface, with the mated pair forming a touch fastener releasably connecting the first and second packaging surfaces.

10. The method of claim 9, wherein the second release liner is peeled back while the adhesive surface of the first patch is permanently adhered to the first packaging surface.

11. The method of claim 9, wherein peeling back the first and second release liners comprises using a strip plate on each side of the fastener assembly, each plate having a flat surface in contact with a back surface of the release liners.

12. The method of claim 9, wherein the first release liner has a lower release resistance than a release resistance of the second release liner.

13. The method of claim 9, wherein permanently adhering the adhesive surface of the first patch comprises pressing the pair of patches to the first packaging surface before peeling back the second release liner.

14. The method of claim 9, wherein the first patch has a width, in a direction across the release liners, that increases with distance from a leading end of the first patch.

15. The method of claim 14, wherein the first patch has an overall area that is less than an overall area of the second patch.

16. The method of claim 9, wherein the first and second patches carry mating touch fastener elements opposite their respective adhesive surfaces, such that the first and second patches form releasably engaged fastening pairs defining touch fastening interfaces therebetween.

17. The method of claim 16, wherein the touch fastening interfaces are configured to enable peeling of the first release liner while leaving the engaged fastening pairs adhered to the second release liner.

* * * * *